US005241903A

United States Patent [19]

Lampic

[11] Patent Number: 5,241,903

[45] Date of Patent: Sep. 7, 1993

[54] GUARD FOR THE NIPS OF ROLLS IN CALENDERS AND THE LIKE

[75] Inventor: Janez Lampic, Mönchengladbach, Fed. Rep. of Germany

[73] Assignee: Kleinewefers GmbH, Krefeld, Fed. Rep. of Germany

[21] Appl. No.: 763,506

[22] Filed: Sep. 20, 1991

[30] Foreign Application Priority Data

Sep. 24, 1990 [DE] Fed. Rep. of Germany ..... 4030150

[51] Int. Cl.[5] ..... B41F 33/08

[52] U.S. Cl. ..... 100/53; 100/173; 100/163 R; 101/216

[58] Field of Search ..... 100/53, 163 R, 166, 100/173; 101/216, 212; 74/609, 613; 68/264; 226/181; 264/175

[56] References Cited

U.S. PATENT DOCUMENTS

| | | | |
|---|---|---|---|
| 3,709,889 | 1/1973 | Steltz | 100/53 |
| 4,454,812 | 6/1984 | Johne et al. | 100/53 |
| 4,669,380 | 6/1982 | Seib et al. | 101/216 |
| 4,765,240 | 8/1988 | Kraus et al. | 101/216 |
| 4,867,055 | 9/1989 | Hütter | 100/173 |
| 4,924,772 | 5/1990 | Schlunke | 100/163 R |

FOREIGN PATENT DOCUMENTS 3838746 5/1990 Fed. Rep. of Germany .

*Primary Examiner*—Harvey C. Hornsby
*Assistant Examiner*—Reginald L. Alexander
*Attorney, Agent, or Firm*—Peter K. Kontler

[57] ABSTRACT

A safety guard for the nip of two neighboring rolls in a calender has an elongated support which is located in front of the nip and has two elongated strip-shaped barriers each adjacent but spaced apart from the peripheral surface of one of the rolls. The support is mounted on the bearings for one of the rolls for pivotal movement about an axis which is parallel to the nip and carries cams which are biased against rollers on the bearings for the other roll by one or more reversible motors. If the bearings for one of the rolls are moved relative to the bearings for the other roll, the cams move along the respective rolls and/or vice versa, whereby the orientation of the support and of the barriers thereon is changed so that the width of the clearances between the barriers and the peripheral surfaces of the adjacent rolls does not exceed a maximum permissible value such as would enable a careless operator to introduce a finger into the nip.

26 Claims, 11 Drawing Sheets

BEST AVAILABLE COPY

GUARD FOR THE NIPS OF ROLLS IN CALENDERS AND THE LIKE

CROSS-REFERENCE TO RELATED CASES

The guard of the present invention constitues an improvement over and a further development of the guard which is disclosed in commonly owned U.S. Pat. No. 4,867,055 granted Sep. 19, 1989 to Hütter et al. for "Guard for the nips of rolls in calenders" and in commonly owned patent application Ser. No. 07/439,541 filed Nov. 20, 1989 by Fenzau et al. for "Guard for the nips of rolls in calenders and like machines", now U.S. Pat. No. 5,042,373 granted Aug. 27, 1991. The disclosures of the aforesaid patents are incorporated herein by reference.

BACKGROUND OF THE INVENTION

The invention relates to calenders and like machines in general, and more particularly to improvements in guards for the nips of rolls in such machines.

German patent application No. 38 38 746 of Hinz et al. (published May 17, 1990) discloses a calender with a guard which can be moved to different positions and is caused to change its position prior to separation of the rolls which define the nip. The guard has a first elongated protector which is closely adjacent the periphery of one of the rolls, and a second elongated protector which is closely adjacent the periphery of the other roll. The purpose of such protectors is to prevent penetration of fingers into the nip when the rolls rotate, e.g., in a machine wherein the rolls serve to impart a particular finish to a running web of paper, foil, textile or other material. It is necessary to ensure that the protectors remain sufficiently close to the respective rolls, not only when the machine employing the rolls is in actual use but also during the intervals of nonuse. This is important in many types of paper calenders because the rolls of such calenders continue to rotate even when they are moved apart to increase the width of the nip. Thus, the danger of injury is present irrespective of the width of the nip between the rolls which are adjacent the two protectors.

The rolls of a paper calender can include so-called filled (soft) rolls and so-called hard rolls (e.g., steel rolls). Irrespective of their exact composition, these rolls must be treated from time to time in order to eliminate damage to their peripheral surfaces. This applies especially for the relatively soft filled rolls. The treatment can involve dressing by a turning, grinding or other suitable tool. Such dressing entails a reduction of the diameter of the treated roll; for example, a fresh roll can have a diameter of 825 mm, and the fresh roll can be subjected to repeated dressing or similar treatments so that its diameter is reduced all the way to 675 mm which is still satisfactory for proper operation of the calender.

The aforementioned guard must be adjusted after each reduction of the diameter of a roll. Hinz et al. propose to employ two feed screws, one at each end of the guard, and each of these feed screws must be manipulated by an operator, i.e., two persons must be in attendance to adjust the position of the guard whenever the diameter of a roll has been changed, either as a result of insertion of a fresh roll or as a result of a reduction of the diameter of a used roll. The adjustment must be the same at each end of the guard, i.e., the width of the clearance between each protector and the peripheral surface of the respective roll must be the same, in order to prevent undue reduction of the clearances (i.e., actual contact between the protectors and the adjacent rolls) or an excessive increase of the width of a clearance which could result in injury to a careless operator. The establishment of actual contact between a protector and the adjacent roll could result in damage to the roll. Thus, it is desirable to ensure that the work which is to be performed by two attendants be carried out in synchronism for the purpose of avoiding injury to operators as well as for the purpose of avoiding damage to a roll. Therefore, the persons in charge of adjusting the position of the guard must proceed slowly, i.e., the interval of idleness of a calender or a like machine subsequent to completion of a dressing operation and reintroduction of the treated roll into the machine is very long and contributes significantly to the down times of the machine.

OBJECTS OF THE INVENTION

An object of the invention is to provide a novel and improved guard which is constructed, and which can be mounted in a calender or in a like machine, in such a way that it can be automatically maintained at an optimum distance from the rolls which define the nip.

Another object of the invention is to provide a guard which can be installed in existing machines as a superior substitute for heretofore known guards.

A further object of the invention is to provide the guard with novel and improved means for positioning its protectors or barriers at an optimum distance from the peripheral surfaces of the respective rolls.

An additional object of the invention is to provide a guard which comprises a small number of simple parts, which need not be manipulated by two or more persons, and which can greatly reduce the down times of a calender or another machine employing rolls which define one or more nips for running webs of paper or other flexible material.

Still another object of the invention is to provide a novel and improved method of mounting and manipulating a guard in a paper calender, another calender or a like machine.

A further object of the invention is to provide a machine which embodies one or more guards of the above outlined character.

SUMMARY OF THE INVENTION

The invention is embodied in a guard for an elongated nip of first and second rolls which have substantially cylindrical peripheral surfaces and spaced apart axes of rotation and are installed in a machine (e.g., in a calender) wherein the first and second rolls are respectively rotatable in first and second bearings and at least one of the bearings is movable relative to the other bearing in order to vary the spacing of the two axes of rotation. The improved guard comprises a support at one side of the nip of the first and second rolls, a first elongated barrier (e.g., a strip of metallic, plastic or other material) provided on the support in parallelism with the nip and defining with the peripheral surface of the first roll a first clearance having a first maximum permissible width, a second elongated barrier provided on the support in parallelism with the nip and defining with the peripheral surface of the second roll a second clearance having a second maximum permissible width (e.g., the same as the first maximum permissible width), means for connecting the support to the first bearing (such connecting means defines for the support a pivot axis which is at least substantially parallel to the nip), and means for pivoting the support about the pivot axis in response to movement of the at least one bearing relative to the other bearing. The purpose of the pivoting means is to ensure that the first and/or the second maximum permissible width is not exceeded when the spacing of the two axes of rotation is changed.

The pivoting means can comprise a first abutment on the second bearing and a second abutment on the support. One of the abutments is preferably provided with a cam face which is tracked by the other abutment. The other abutment can comprise a roller.

Such guard can further comprise means for adjustably supporting at least one of the abutments, i.e., for adjustably supporting the first abutment on the second bearing and/or for adjustably supporting the second abutment on the support.

The guard preferably further comprises means (e.g., a double acting hydraulic or pneumatic cylinder and piston motor) for urging one of the abutments against the other abutment, e.g., for urging the second abutment against the first abutment. Such urging means can be said to form part of the pivoting means. If the second roll is movable relative to the first roll along a predetermined path between an operative position (in which the first and second rolls define the aforementioned nip) and an inoperative position (e.g., outside of the frame of a calender), the urging means can comprise a reversible motor (such as the aforementioned double-acting fluid-operated motor) having means (such as a piston rod) for pivoting the support in a first direction to thereby maintain the cam face in engagement with the other abutment in the operative position of the second roll, and in a second direction to a retracted position away from the aforementioned path so that the second roll is free to move between its operative and inoperative positions.

The guard can further comprise a carriage which mounts the first abutment for movement away from the support in response to movement of the at least one bearing away from the other bearing. The at least one bearing can be pivotable relative to the other bearing in the frame or housing of the machine in which the guard is put to use. The guard which is used in such machine can further comprise a cam which is rigid with the machine frame and means for urging the carriage against the cam. Such urging means can include or constitute the aforementioned means for urging one of the abutments against the other abutment The frame can include a carrier for the cam, and the urging means can comprise means for biasing the support so that the second abutment bears against the first abutment and the first abutment urges the carriage against the cam. The carriage can comprise a roller which engages the cam. The first abutment can comprise a second roller which is provided on the carriage, and the second abutment can comprise a second cam including the aforementioned cam face and bearing against the second roller under the action of the biasing means.

The carriage can include a bell crank lever or another part which is pivotable relative to the other bearing, and the guard then further comprises a fulcrum which rockably connects the carriage to the second bearing, and means for rocking the carriage relative to the second bearing in response to pivoting of the at least one bearing relative to the other bearing. The carriage can be provided with an opening, and the rocking means can comprise a motion transmitting member which is rigid with the first bearing and a coupling element connecting the motion transmitting member with the carriage and extending into the opening. Such coupling element can comprise or constitute a pin. The motion transmitting member can be provided with an aperture which registers at least in part with the opening of the carriage, and the coupling element extends into the opening of the carriage as well as into the aperture of the motion transmitting member. The opening and the aperture can be elongated and preferably extend substantially at right angles to the nip.

The coupling element is movable toward and away from the fulcrum to thus change the transmission ratio of the rockable carriage, and the guard can further comprise means for varying the distance of the coupling element from the fulcrum in response to pivoting of the at least one bearing relative to the other bearing. The distance varying means preferably comprises an elongated actuator including a first portion which is preferably movably connected with the first bearing and a second portion which is preferably movably connected with the second bearing. The coupling element is provided on the actuator. The aforementioned portions of the actuator are movable relative to the respective bearings and the bearings preferably comprise means for preventing or limiting the movements of portions of the actuator transversely of the nip. Means can be provided for adjustably mounting the coupling element on the actuator. The latter can comprise a base or holder for the first and second portions, and means for adjustably connecting at least one of these portions to the base or holder. The coupling element can be disposed between the first and second portions of the actuator.

The coupling element can include a friction reducing portion (e.g., an idler wheel) which engages the carriage, and the coupling element can further include a friction reducing portion (e.g., an idler roller) which engages the motion transmitting member.

The novel features which are considered as characteristic of the invention are set forth in particular in the appended claims. The improved guard itself, however, both as to its construction and the mode of installing and adjusting the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
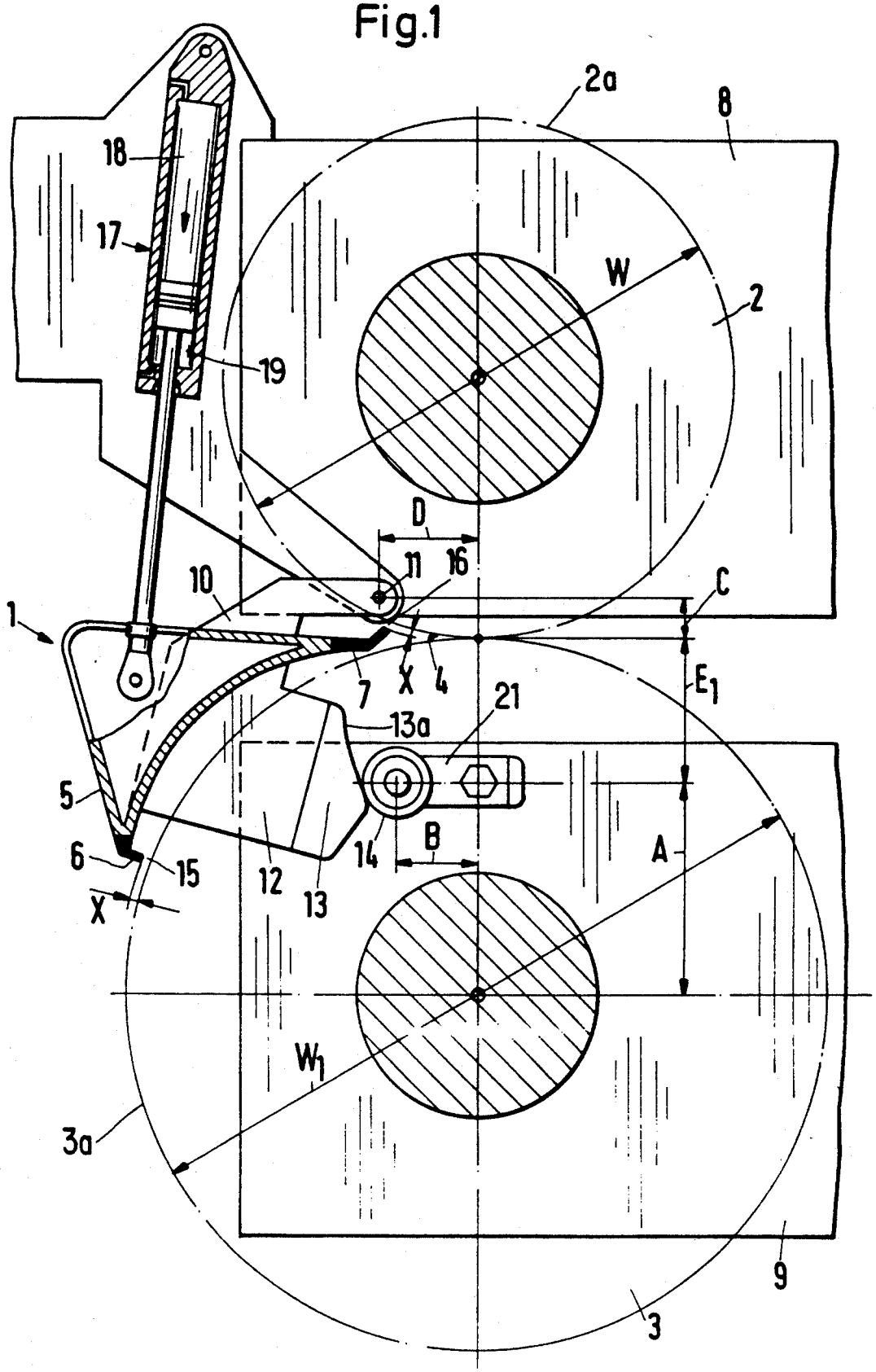
FIG. 1 is a partly end elevational and partly vertical sectional view of a guard which embodies one form of the invention and is installed in a machine wherein one of the rolls is reciprocable up and down relative to the other roll, the two rolls being shown in their operative positions.
Figure 2:
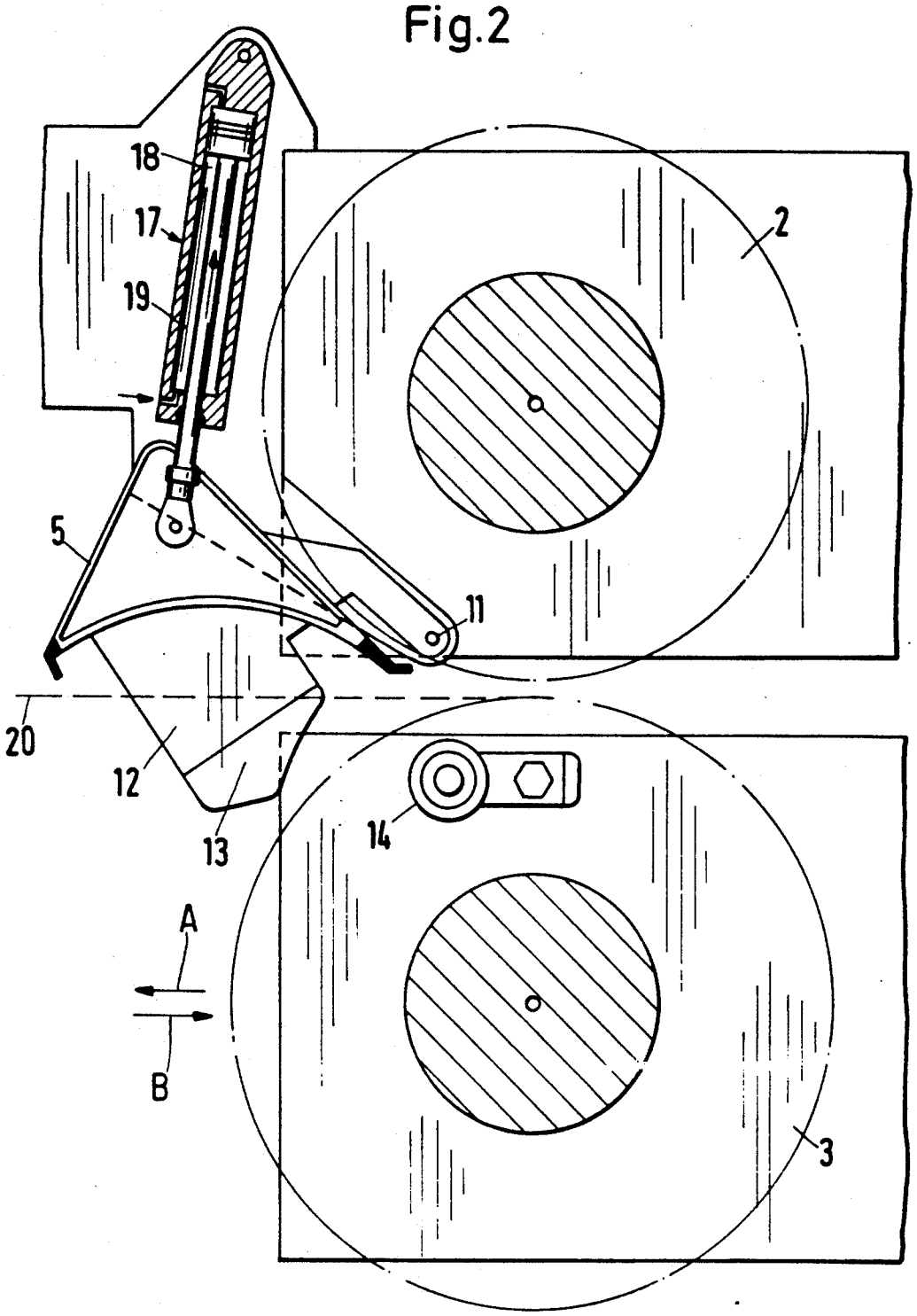
FIG. 2 shows the structure of FIG. 1 but with the lower roll moved away from the upper roll preparatory to movement to an inoperative position, the guard being shown in the retracted position in which it is adjacent the path of movement of the lower roll between operative and inoperative positions.
Figure 3:
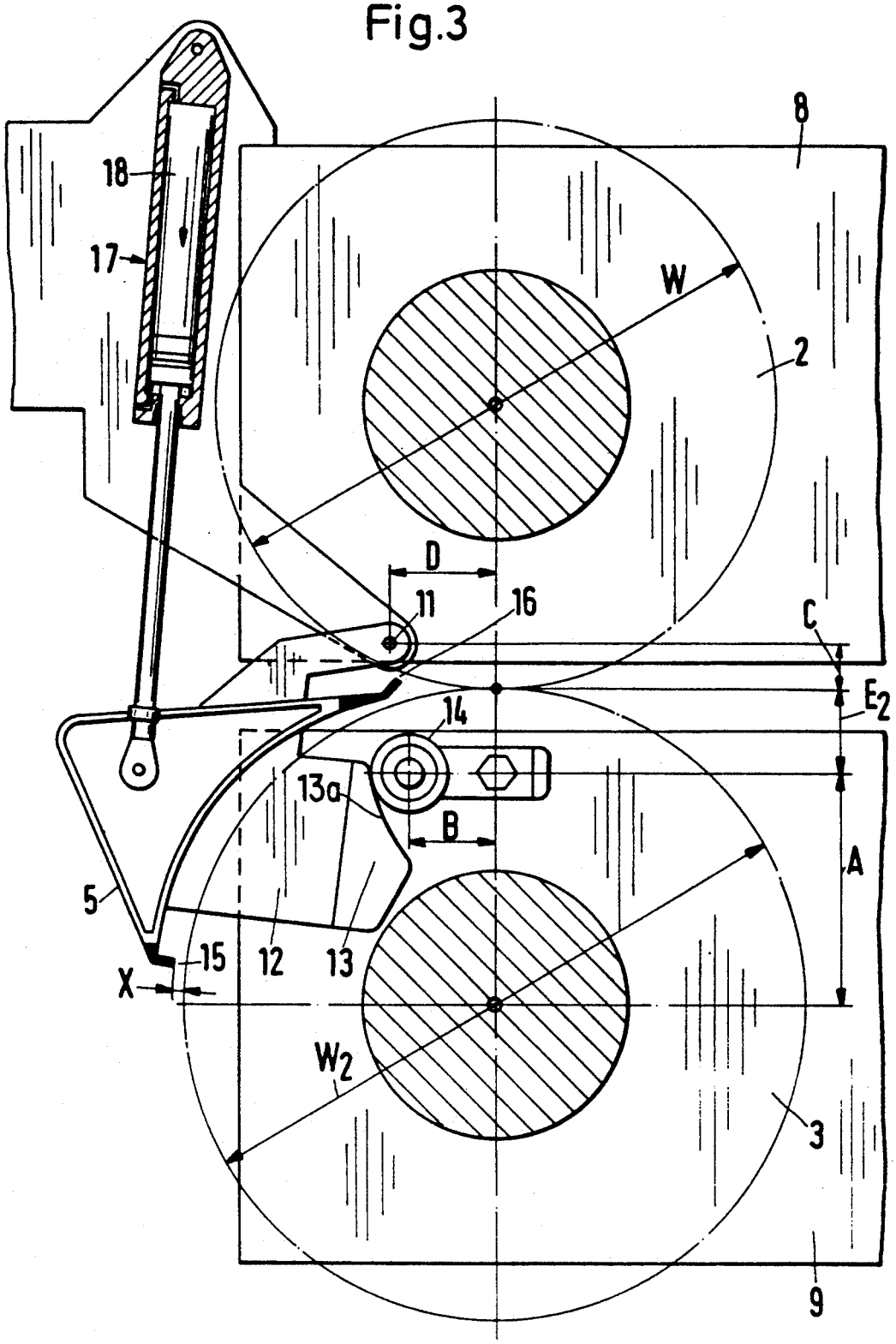
FIG. 3 shows the structure of FIGS. 1 or 2 upon insertion of a smaller-diameter lower roll.

The guard 1 which is shown in FIGS. 1 to 3 is adjacent one side of an elongated nip 4 of two parallel rolls (indicated by phantom lines) including an upper roll 2 mounted in a pair of first guides or bearings 8 (only one shown) and a lower roll 3 mounted in a pair of second guides or bearings 9 (only one shown). The illustrated guard 1 comprises an elongated hollow profiled support 5 which can be of the type described and shown in the aforementioned commonly owned U.S. Pats. to Hütter et al and Fenzau et al. The support 5 carries a first elongated strip-shaped barrier or protector 7 which is adjacent the peripheral surface 2*a* of the roll 2 and defines with the latter an elongated clearance or gap 16 having a predetermined maximum permissible width (the width of the clearance 16 which is shown in FIG. 1 is indicated by the character X), i.e., the width of such clearance should not exceed a certain maximum value (for example, 8 mm) which is not sufficient to permit the introduction of a finger into the nip 4. A second elongated strip-shaped protector or barrier 6 on the support 5 is adjacent the peripheral surface 3*a* of the roll 3 and defines with the latter a second clearance or gap 15. The width (shown at X) of the clearance 15 should not exceed a predetermined maximum permissible value (e.g., the same maximum permissible value as the width of the clearance 15) in order to avoid injury to an operator. As can be seen in FIGS. 1 to 3, the cross-sectional outline of the barrier 7 can depart from the cross-sectional outline of the barrier 6.

The end portions of the support 5 are provided with arms 10 (one shown) forming part of a means for connecting the support 5 and its barriers 6, 7 to the bearings or guides 8 (hereinafter called bearings) for the upper roll 2 in such a way that the support can be pivoted about the common axis of two pivot members 11 forming part of the connecting means 10+11 and defining for the support 5 a pivot axis which is substantially or exactly parallel with the nip 4. Each pivot member 11 is provided on one of the bearings 8.

The guard 1 further comprises means for pivoting the support 5 and the barriers 6, 7 about the axis of the pivot member 11, and such pivoting means comprises a composite abutment on the bearings 9 for the roll 3 and a composite abutment on the support 5. The composite abutment on the support 5 comprises two holders 12 which are provided at the ends of the support and each of which carries a plate cam 13 having a cam face 13*a*. The other composite abutment comprises two idler rollers 14 which are preferably adjustably mounted on the two bearings 9 at the respective axial ends of the roll 3 and abut the respective cam faces 13*a*. The rollers 14 are adjustable along horizontal paths extending at right angles to the parallel axes of rotation of the rolls 2 and 3. The arrangement is such that the vertical distance A from the horizontal plane including the axis of the roll 3 to the horizontal plane including the common axis of the rollers 14 is a fixed distance. However, the horizontal distance B of the vertical plane of the common axis of the rollers 14 from the vertical plane including the axes of rotation of the rolls 2, 3 can be changed by moving the rollers 14 in a direction to the left or to the right (as viewed in FIGS. 1, 2 or 3).

The position of the pivot axis for the support 5 (i.e., of the common axis of the pivot members 11) relative to the axis of rotation of the roll 2 is fixed, i.e., the horizontal distance D of the vertical plane including the common axis of the pivot members 11 from the common vertical plane of the axes of rotation of the rolls 2, 3 does not change, and the same holds true for the vertical distance C of the horizontal plane of the common axis of the pivot members 11 from the horizontal plane of the nip 4 and/or the vertical distance W/2−C of the horizontal plane of the common axis of the pivot members 11 from the horizontal plane including the axis of the roll 2 (wherein W is the diameter of the roll 2).

The width X of the clearances 15 and 16 depends upon the selected horizontal distance D of the common axis of the rollers 14 from the common vertical plane of the axes of the rolls 2, 3. Such width decreases if the horizontal distance B is reduced, i.e., the exact width of the clearances 15, 16 can be selected by appropriate selection of the distance B which is variable because the rollers 14 are or can be mounted on slides or carriages 21 or analogous means which serve as a means for adjustably supporting the rollers 14 in that they can be shifted horizontally toward and away from the common vertical plane of the axes of the rolls 2 and 3.

The guard 1 of FIGS. 1 to 3 further comprises means for urging the cam faces 13*a* of the cams 13 against the respective rollers 14, i.e., for urging one (including the cams 13) of the two composite abutments against the other composite abutment (rollers 14). The illustrated urging means comprises at least one double-acting hydraulic cylinder and piston motor 17 (this motor can be termed a reversible motor). When the upper chamber 18 of the cylinder of the motor 17 receives a pressurized gaseous or hydraulic fluid and the lower chamber 19 is permitted to discharge its contents into a sump or into the surrounding atmosphere (depending upon the nature of the fluid), the piston rod of the motor 17 (such piston rod is articulately connected to the support 5) urges the cams 13 against the respective rollers 14 to thus ensure that the positions of the support 5 and of the barriers 6, 7 will change as a function of the configuration of the cam faces 13*a* when the rollers 14 are moved to alter the horizontal distance B and/or when the bearings 9 are moved relative to the bearings 8 and/or vice versa. The cylinder of the motor 17 is articulately connected to one bearing 8 for the upper roll 2, i.e., to that bearing which carries the pivot member or members 11. In the apparatus which is shown in FIGS. 1 to 3, the motor 17 normally urges the support 5 downwardly, i.e., this support tends to pivot in a counterclockwise direction about the common horizontal axis of the pivot members 11 and is at least substantially parallel to the nip 4. The guard 1 preferably comprises two synchronously operated motors 17, one on each of the bearings 8.

The character $E_1$ denotes in FIG. 1 the vertical distance of the horizontal plane of the nip 4 from the horizontal plane of the common axis of the rollers 14. The vertical distance $C+E_1$ denotes the approximate distance of the common axis of the pivot members 11 from the points where the cam faces 13*a* bear upon the peripheral surfaces of the respective rollers 14.

The motor or motors 17 can serve an additional purpose, namely of moving (pivoting) the support 5 and its barriers 6, 7 out of the way (namely out of the horizontal path of movement of the lower roll 3 when the latter is to be withdrawn from the machine for the purposes of inspection, repair or replacement. In FIG. 2, the normally horizontal path for movement of the roll 3 between the operative position of FIG. 2 and an inoperative position is indicated by a horizontal phantom line 20. When the lower chamber 19 of the cylinder in the motor 17 of FIG. 2 receives a pressurized fluid and the upper chamber 18 is free to discharge its contents, the piston rod of the motor 17 is retracted and the support 5 and its barriers 6, 7 are maintained above the level of the path (20) of movement of the lower roll 3 between its operative and inoperative positions. The direction of movement of the roll 3 away from the operative position is indicated by an arrow A, and the direction of movement of the roll 3 back to its operative position (or the direction of movement of a fresh roll 3 to the operative position) is indicated by arrow B. Thus, each motor 17 is indeed a reversible motor in that it is capable of pivoting the support 5 in a clockwise direction or in a counterclockwise direction.

The withdrawn roll 3 is thereupon treated, e.g., to repair the damage to its peripheral surface, whereby its diameter decreases from $W_1$ (FIG. 1) to $W_2$ (FIG. 3). When the thus repaired roll 3 is reintroduced into and is properly installed in the machine, the distance between the bearings 8 and 9 is less than prior to treatment. This entails a reduction of the distance of the horizontal plane of the common axis of the pivot members 11 from the horizontal plane of the common axis of the rollers 14 from $C+E_1$ (FIG. 1) to $C+E_2$ (FIG. 3). The difference between $E_1$ and $E_2$ equals half the difference between the diameters $W_1$ and $W_2$.

The motor or motors 17 pivot the support 5 of the guard 1 from the retracted position of FIG. 2 to the position of FIG. 3 in which the clearances 15 and 16 are reestablished and the width X of such clearances is again less or not more than the predetermined maximum permissible value. Pivoting of the support 5 from the position of FIG. 2 to the position of FIG. 3 is terminated when the cam faces 13*a* reengage the respective rollers 14. Due to a reduction of the distance of the horizontal plane of the nip 4 from the horizontal plane of the common axis of the rollers 14 (from $E_1$ to $E_2$), the rollers 14 engage different portions of the respective cam faces 13*a* as can be readily ascertained by comparing FIGS. 1 and 3. The distance of the rolls 14 from the support 5 (in the position of FIG. 3) is reduced because the angular position of the support is different (the length of the exposed portion of the piston rod of the illustrated motor 17 is greater in FIG. 3 than in FIG. 1). The just described mode of mounting and pivoting the support 5 renders it possible to ensure that the width X of the clearances 15, 16 prior to dressing or an analogous treatment of the roll 3 is the same or nearly the same as subsequent to dressing and reintroduction of the reduced-diameter roll 3 into the machine, i.e., the width X is not unduly increased as a result of a reduction of the diameter of the roll 3 from $W_1$ to $W_2$.

Another advantage of the improved guard 1 is that the acceptable or optimum width W of the clearances 15, 16 is reestablished in automatic response to pivoting of the cam faces 13*a* back into engagement with the respective rollers 14. Thus, all that is necessary is to operate the motor or motors 17 in a direction to pivot the support 5 about the common axis of the pivot members 11 (in a counterclockwise direction from the position of FIG. 2 to the position of FIG. 3); pivoting of the support 5 is terminated in automatic response to engagement of the cam faces 13*a* with the respective rollers 14 whereby the width X of the clearances 15, 16 is again less than (or does not exceed) the maximum permissible width. It will be seen that the positions of the support 5 and of its barriers 6, 7 can be changed by one or two motors 17 without resorting to any manual adjustment which is necessary in accordance with heretofore known proposals. This not only reduces the cost of operating the machine (adjustment of the position of the support 5 does not necessitate the presence of two attendants) but also greatly reduces the likelihood of damage to (particularly twisting of) the support 5 and/or barriers 6 and 7 as well as the likelihood of damage to the repaired roll 3 and/or to the roll 2 as a result of direct contact with component parts of the guard 1. It can be said that the support 5 and its barriers 6, 7 are positively guided in all of their movements such as those between the positions of FIG. 1 and the positions of FIG. 2 as well as those between the positions of FIG. 2 and the positions of FIG. 3.

It is necessary, from time to time, to separate the rolls 2 and 3 for any one of a variety of reasons, for example, in response to the development of a break or tear in a web which is transported through the nip 4. Such separation is effected, or should be effected, as expeditiously as possible in order to reduce the down times of the machine. As a rule, or in many machines, the rolls 2 and 3 continue to rotate for a certain period of time (due to inertia) subsequent to widening of the nip 4. Therefore, the guard 1 must be effective to prevent injury to a careless attendant not only when the width of the nip 4 corresponds to that which is shown in FIGS. 1 and 3 but also when the width of the nip is increased, e.g., to facilitate access to and/or removal of a damaged web of paper or other flexible strip or sheet material.

Figure 4:
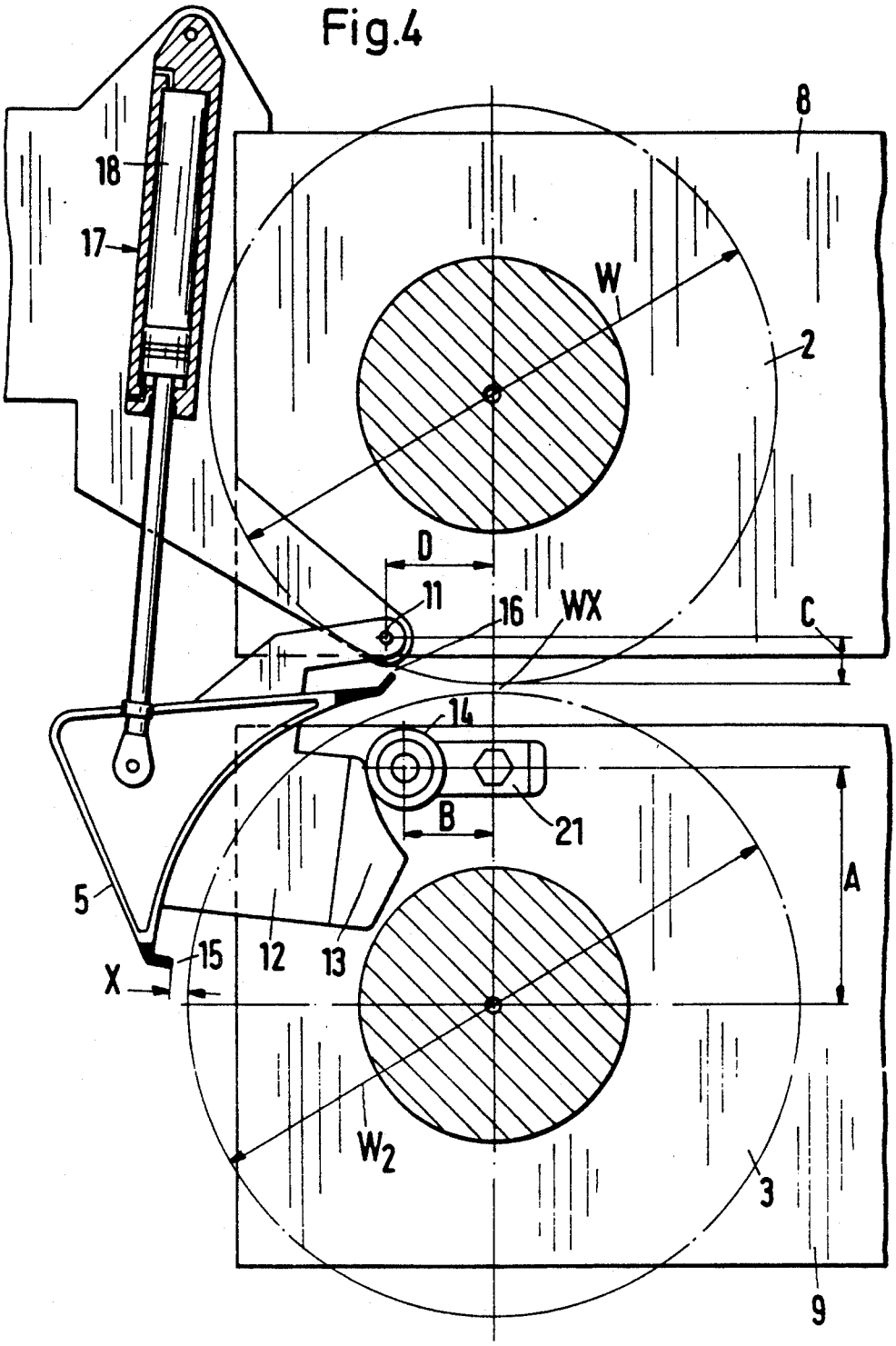
FIG. 4 shows the structure of FIG. 3, with the lower roll moved away from the upper roll to increase the width of the nip of the upper and lower rolls.

FIG. 4 shows a nip having a width WX which is greater than the width of the nip in operative positions of the rolls 2 and 3. For example, the nip of the rolls 2, 3 in FIG. 4 can have a width WX of approximately 3 mm. This is tantamount to an increase of the diameter $W_2$ of the roll 3 by approximately 6 mm, and the orientation of the support 5 must be altered accordingly. The width of the clearance 16 remains unchanged or nearly unchanged because the pivot members 11 are mounted on the bearings 8 for the upper roll 2 (it is assumed that the width of the nip has been increased as a result of downward movement of the bearings 9 for the lower roll 3). The width of the clearance 15 is increased to a certain extent but can still remain below the maximum permissible width by the simple expedient of ensuring that the width of the clearance 15 is appreciably less than the maximum permissible width prior to movement of the bearings 9 in a direction to increase the width of the nip 4 to WX.

The angular position of the support 5 relative to the plane including the axes of rotation of the rolls 2 and 3 depends upon the diameters of the rolls. As the diameter of the roll 3 decreases, the inclination of the support 5 relative to the aforementioned plane must change in order to ensure that the width X of the clearance 15 will not rise above the predetermined maximum permissible value. As mentioned above, such change of inclination need no longer be effected by two workers each of whom is in charge of rotating a discrete feed screw; instead, the adjustment of the inclination of the support 5 is automatic and is effected by the motor or motors 17 in conjunction with the aforediscussed abutments including the pair of cams 13 on the support 5 and the pair of rollers 14 on the respective bearings 9 for the lower roll 3. The transmission including the cams 13 and the associated rollers 14 will change the inclination of the support 5 and hence the positions of the barriers 15, 16 in dependency upon the change of distance of the bearings 9 from the bearings 8, i.e., in dependency upon the change of the diameter of the roll 3.

The support 5 is directly connected to the bearings 8 by the respective pivot members 11 and indirectly engages the lower bearings 9 by way of the transmission including the holders 12, cams 13 and rollers 14. Therefore, any change of the distance of the bearings 9 from the bearings 8 is directly evaluated and is converted into a corresponding angular movement of the support 5 about the common axis of the pivot members 11 to thus ensure automatic and optimal adjustment of the positions of the barriers 6, 7 relative to the peripheral surfaces of the respective rolls 3 and 2. This holds true irrespective of whether the bearings 9 are raised or lowered for the purpose of altering the width of the nip 4 or whether the bearings 9 must be moved up or down because the lower roll 3 is to be replaced with a lower roll having a smaller or larger diameter. For example, and as fully described above, angular adjustment of the support 5 is carried out in a fully automatic way in response to reinsertion of a previously removed roll 3 after the roll 3 has undergone a treatment which involved a reduction of its diameter. All that is necessary is to admit a pressurized fluid into the upper chamber 18 of each motor 17; the motor or motors then pivot the support 5 until the cams 13 reach and engage the respective rollers 14 to thus ensure that the width X of each of the clearances 15, 16 will remain below or will not exceed the predetermined maximum permissible value.

The configuration of the cam faces 13*a* can be readily selected in such a way that the distance of the support 5 from the abutments on the bearings 9 is greater when the distance of the bearings 9 from the bearings 8 is greater and vice versa. This holds true irrespective of whether the cams 13 are mounted on the support 5 or on the bearings 9, i.e., whether the rollers 14 are mounted on the bearings 9 or on the support 5.

The changes of the distance of the barrier 7 from the peripheral surface of the roll 2 are relatively small, even if the support 5 is moved along a large arc about the common axis of the pivot members 11, because the end portions of the barrier 7 are closely adjacent the respective bearing members 11 and also because it is assumed that the diameter of the upper roll 2 is substantially constant.

The abutments on the bearings 9 need not include rollers (14). However, such rollers are preferred at this time because they can roll along the respective cam faces 13*a* with a minimum of friction. Such reduction of friction ensures that the cams 13 will be free to move along the respective rollers 14 to the desired optimal positions solely in dependency upon the distance of the bearings 9 from the bearings 8 rather than being arrested at an earlier stage of movement due to pronounced friction between the cam faces 13*a* and the components of the composite abutment on the bearings 9.

Adjustability of the rollers 14 toward and away from the common plane of the axes of rotation of the rolls 2 and 3 is desirable and advantageous because the operators can select the width of the nip 4, i.e., the operators can alter the width of the nip if this is necessary for optimal treatment of one or more running webs which are caused to pass through the nip 4 when the machine embodying the structure of FIGS. 1 to 4 is in actual use. Each of the carriages 21 for the rollers 14 can releasably fixed to the respective bearing 9 by a threaded fastener or in any other suitable way. The carriages 21 can be caused to slide in suitable tracks (e.g., slotted horizontal tracks) in the respective bearings 9.

The rollers 14 and their carriages 21 do not interfere with movements of the bearings 9 toward and away from the bearings 8 and/or with movements of the roll 3 in the direction of arrow A or B. The positions of the carriages 21 relative to the respective bearings 9 are preferably adjustable while the machine including the rolls 2, 3 and the guard 1 is fully assembled. This can be readily achieved by making the aforementioned fasteners for the carriages 21 accessible at the outer sides of the respective bearings 9.

The motor or motors 17 constitute an optional but desirable feature of the improved guard 1. Thus, it is possible to rely solely on gravity in order to ensure that the cams 13 will remain in engagment with the respective rollers 14. However, if the guard 1 comprises one or two motors 17 and the chambers 18 of such motors are filled with a pressurized fluid while the machine is in actual use, the width of the clearances 15, 16 is not likely to be accidentally increased due to shaking or other stray movements of the machine or of the guard 1. Thus, the motor or motors 17 invariably urge the cams 13 against the respective rollers 14 so that the width X of the clearances 15, 16 is determined primarily or exclusively by the configuration of the cam faces 13*a*.

Another advantage of the motor or motors 17 is that they render it possible to mechanically lift the support 5 and its barriers 6, 7 preparatory to movement of the roll 3 from its operative position to the inoperative position, e.g., for the purpose of dressing or for any other reason. Though it is possible to employ a first motor or a first set of motors which serve to urge the cams 13 against the respective rollers 14 and to employ one or more additional motors which can be actuated to pivot the support 5 to the raised position of FIG. 2, it is presently preferred to employ one or more "reversible" motors 17 which serve the dual purpose of maintaining the cams 13 in engagement with the adjacent rollers 14 as well as of pivoting the support 5 to the position of FIG. 2 before the roll 3 is moved away from the operative position and maintaining the support 5 in the position of FIG. 2 until after the roll 3 is returned to operative position or until after a different roll is installed in the machine in lieu of the removed roll 3.

Figure 5:
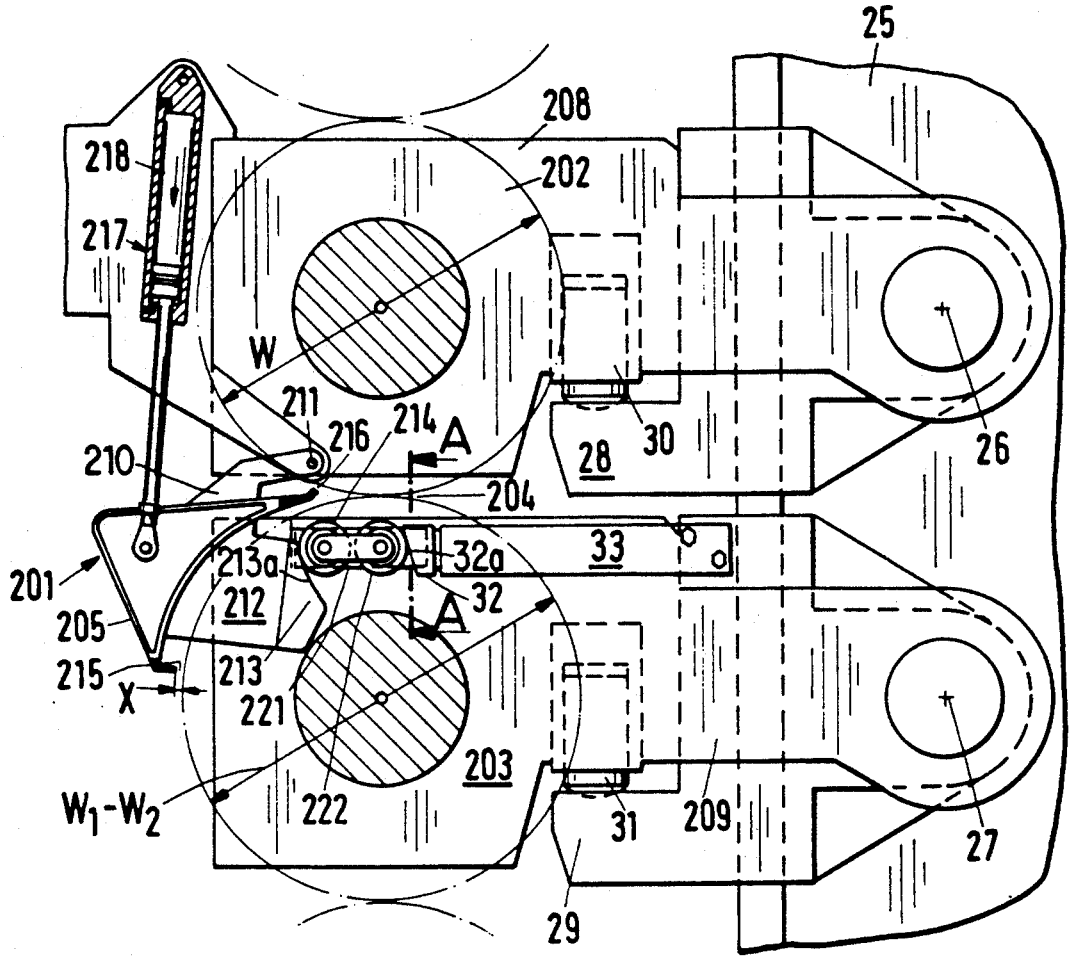
FIG. 5 is a partly end elevational and partly vertical sectional view of a modified guard which is installed in a machine having rolls mounted on pairs of pivotable bearings, the guard being shown in a position in front of the nip of the two rolls.
Figure 6:
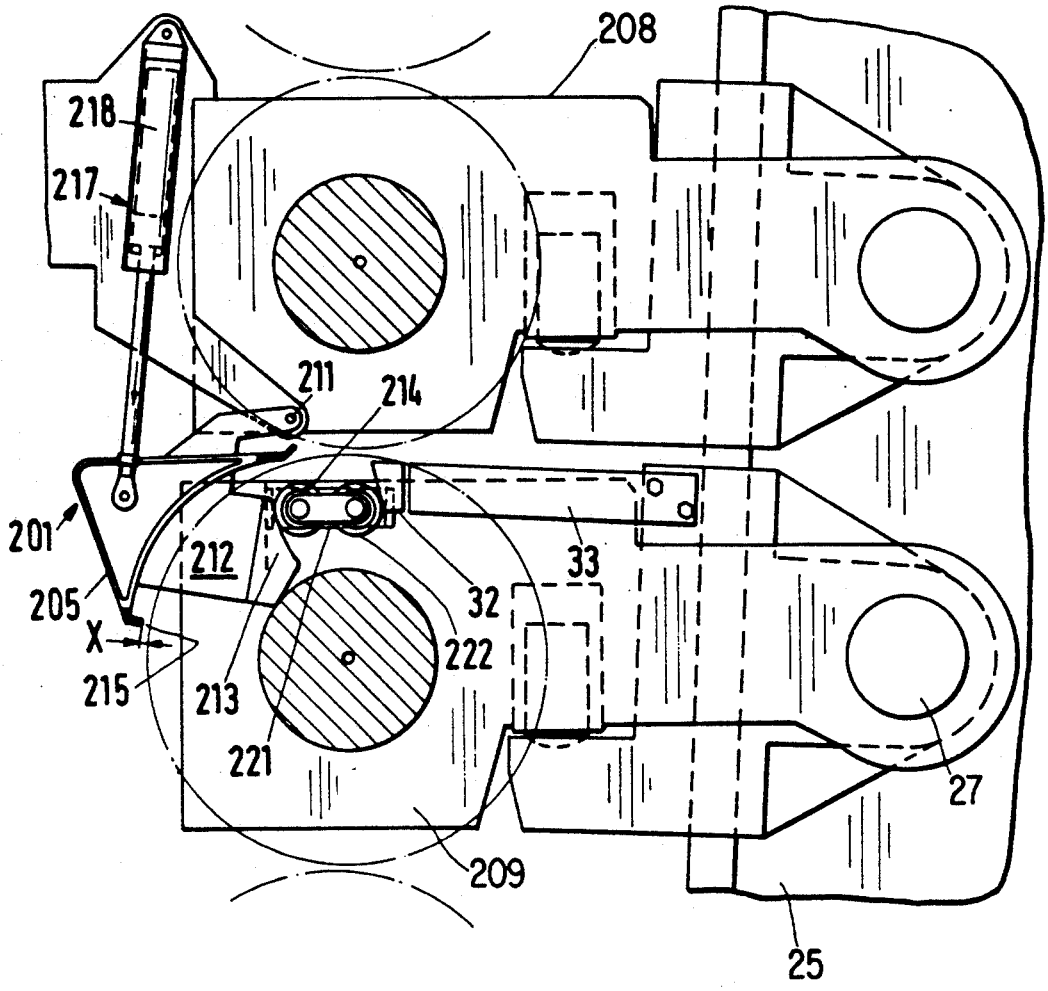
FIG. 6 shows the structure of FIG. 5 but with the rolls spaced apart from each other.
Figure 7:
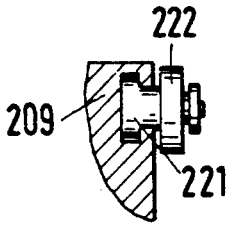
FIG. 7 is an enlarged fragmentary sectional view substantially as seen in the direction of arrows from the line A—A in FIG. 5.

FIGS. 5 to 7 show a modified guard 201 in a modified machine. All such parts of the guard 201 which are identical with or clearly analogous to corresponding parts of the guard 1 are denoted by similar reference characters plus 200.

The rolls 202, 203 are installed in a machine (e.g., a calender) with pairs of pivotable bearings 208, 209 in the form of levers. Reference may be had, for example, to commonly owned U.S. Pat. No. 4,924,772 granted May 15, 1990 to Schlunke et al. for "Calender with individually supported rolls and constant nip alignment". The bearings 208, 209 are respectively pivotable about the horizontal axes of shafts 26, 27 which are installed in a frame or housing 25. A stop 28 forms part of means for limiting the extent of angular movability of the illustrated bearing 208 in a counterclockwise direction (i.e., in a direction to move the upper roll 202 toward the lower roll 203), and a stop 29 forms part of means for limiting counterclockwise movements of the bearing 209, i.e., for limiting the extent of movability of the lower roll 203 away from the upper roll 202. The stop 28 cooperates with a fluid-operated motor 30 (e.g., a hydraulic or pneumatic cylinder and piston unit) to pivot the bearing 208 about the axis of the shaft 26, and the stop 29 cooperates with a similar motor 31 to pivot the bearing 209 about the axis of the shaft 27.

The illustrated roller 214 of the abutments on the bearings 209 for the lower roll 203 is installed in a reciprocable carriage or slide 221 which is movable relative to the respective bearing 209 in a substantially horizontal plane toward and away from the support 205 of the guard 201. The carriage 221 mounts a second roller 222 which engages the face 32*a* of a cam 32 mounted on a stationary projecting portion or carrier 33 of the housing or frame 25. The face 213*a* of the cam 213 is biased against the adjacent roller 214 when the upper chamber 218 of the cylinder in the illustrated motor 217 receives a pressurized fluid, and the roller 214 then urges the carriage 221 in a direction to the right (as viewed in FIG. 5) so that the roller 222 bears against the face 32*a* of the cam 32. When the pressure in the cylinder chamber 218 rises, the motor 217 tends to pivot the support 205 in a counterclockwise direction (about the common axis of the pivot members 211 on the bearings 208 for the upper roll 202), and the support 205 urges the cams 213 in a direction having a large horizontal component to thus ensure that the cam faces 213*a* bear upon the adjacent rollers 214 which, in turn, ensure that the rollers 222 bear against the faces 32*a* of the respective cams 32.

The manner in which the illustrated carriage 221 is guided in the respective bearing 209 is shown in FIG. 7. The other carriage 221 (not shown) is or can be mounted in the other bearing 209 in the same way.

If the rolls 202, 203 are to be separated from each other (this is shown in FIG. 6), the lower bearings 209 are pivoted in a counterclockwise direction about the axis of the shaft 27. However, the level of the second cams 32 remains unchanged because the carriers 33 of these cams are fixedly mounted in or form integral parts of the housing or frame 25. Thus, pivoting of the bearings 209 in a counterclockwise direction results in a movement of the second rollers 222 along the faces 32*a* of the respective stationary cams 32. This is ensured by the motor or motors 217 which impart to the support 205 a tendency to pivot in a counterclockwise direction (about the common axis of the pivot members 211). The extent of rightward movement of the carriages 221 is dependent upon the extent of counterclockwise pivotal movement of the bearings 209 about the axis of the shaft 27. The configurations of the cam faces 213*a*, 32*a* are such that the support 205 is compelled to assume an orientation in which the width X of the clearances 215, 216 does not exceed the prescribed maximum permissible value irrespective of the angular positions of the bearings 209. In fact, the configurations of the cam faces 213*a*, 32*a* can be readily selected in such a way that the width X remains at least substantially constant in each of a number of different angular positions of the arms 210 of the support 205 relative to the common axis of the pivot members 211 on the bearings 208.

If the width of the nip 204 is to be reduced again (e.g., back to the width which is shown in FIG. 5), the bearings 209 are pivoted about the axis of the respective shaft 27 whereby the rollers 222 travel along the respective cam faces 32*a* and the carraiges 221 are pushed (by the stationary cams 32) to the left, i.e., toward the support 205 of the guard 201. This causes the rollers 214 to pivot the support 205 in a clockwise direction through the medium of the cams 213 and their holders 212 so that the orientation of the support 205 is changed and the width X of the clearances 215, 216 remains within the acceptable range, i.e., such width does not exceed the maximum permissible value.

If the diameter of the roll 203 is reduced from $W_1$ to $W_2$, the angular position of the support 205 is changed automatically in a manner as described in connection with FIGS. 1 to 4 so that the width X of the clearances 215, 216 remains at least substantially unchanged.

An important advantage of the guard 201 is that the carriages 221 ensure automatic adjustment of inclination or orientation of the support 205 in response to rapid separation of the rolls 202, 203, e.g., for the purpose of removing a torn or broken web which extends through the nip 204. This is due to the fact that the weight of the support 205 and/or the motor or motors 217 automatically move the carriages 221 to the right (as viewed in FIG. 5) when the bearings 209 are moved downwardly and away from the bearings 208. As already explained above, this is due to the fact that the cams 213 continue to urge the rollers 214 to the right while the bearings 209 are caused to pivot in a counterclockwise direction (in order to move the roll 203 downwardly and away from the roll 202) Therefore, the rollers 222 roll along the respective cams 32 the cam faces 32*a* of which are inclined in such a way that they enable the carriages 221 to move to the right in response to counterclockwise pivoting of the bearings 209.

Rapid separation of rolls is particularly important in certain calenders which are used for the treatment of paper webs. The rolls 202, 203 in such calenders continue to rotate for a certain period of time subsequent to widening of the nip 204 and, in the absence of immediate and automatic adjustment of the angular position of the support 205, the width of the clearance 216 and/or 215 could be temporarily increased above the maximum permissible value. The guard 201 of FIGS. 5 to 7 compensates for rapid separation of the roll 203 from the roll 202 in the same way as if the roll 203 were replaced with a larger-diameter roll, i.e., the support 205 is pivoted in a counterclockwise direction about the common axis of the pivot members 211 in order to prevent undue widening of the clearance 215 between the peripheral surface of the lowered roll 203 and the barrier 216.

Pivoting of the support 205 through an optimum angle is ensured by the carriages 221 in cooperation with the rollers 222 and cams 32 because the carriages 221 can move to the right and thus enable the support 205 to pivot in a counterclockwise direction so that the width X of the clearance 215 does not exceed the maximum permissible value. Such adjustment of angular position of the support 205 is carried out in automatic response to abrupt or relatively slow pivoting of the bearings 209 in a direction to move the roll 203 downwardly and away from the roll 202.

FIGS. 8 to 11 illustrate certain details of a third guard 301. All such parts of this guard which are identical with or clearly analogous to corresponding parts of the guard 1 are denoted by similar reference characters plus 300. The guard 301 is installed in a machine having rolls 302, 303 which are mounted between pairs of bearings 308, 309 in the form of levers corresponding to the bearings or levers 208, 209 of FIGS. 5 and 6.

Each roller 314 is mounted on a carriage 335 in the form of a bell crank lever which is pivotable or rockable relative to the respective bearing 309 about the horizontal axis of a fulcrum 336. Such axis is substantially parallel to the axes of rotation of the rolls 302, 303 and to the nip 304.

When the rolls 302, 303 are to be separated, i.e., if the width of the nip 304 is to be increased, the rollers 314 must move along the faces 313*a* of the respective cams 313 in order to ensure that such increase of the width of the nip 304 does not entail an excessive increase of the width X of the clearance 315 between the barrier 306 and the peripheral surface of the roll 303. This is accomplished in that each carriage 335 is caused to change the level of the respective roll 314 by pivoting in a clockwise direction so that the rolls 314 are moved to a higher level. Such pivoting of the carriages 335 takes advantage of the horizontal distance S of the vertical plane of the axis of rotation of the roll 203 from the vertical plane of the axis of rotation of the roll 302 in response to pivoting of the bearings 308 and/or 309 about the axes of the respective shafts 326, 327 in the housing or frame 325 (see FIG. 10).

The guard 301 further comprises a displacing or rocking device 337 for the carriages 335. The purpose of the rocking device 337 is to change the angular positions of the carriages 335 in response to pivoting of the bearings 308 and/or 309. The illustrated rocking device 337 comprises a pin-shaped coupling element 338 for each of the carriages 335, and each coupling element 338 (hereinafter called pin for short) is installed in a slot-shaped opening 339 of the respective carriage 335. Each roller 314 is mounted on one arm and the slot-shaped opening 339 is provided in the other arm of the respective carriage 335. Each pin 338 further extends through a slot-shaped aperture 348 of a motion transmitting member 340 which is affixed to the adjacent bearing 308. The aperture 348 is in partial or full register with the respective opening 339.

If the bearings 309 are pivoted in a direction to lower the roll 303, the pins 338 are caused to move in a direction to the right (relative to the respective bearings 309) through the distance S (which is the distance between the vertical planes of the axes of rotation of the rolls 302 and 303). This causes the carriages 335 to pivot about the axes of the respective fulcra 336 and the rollers 314 move downwardly along the faces 313*a* of the respective cams 313. This causes the support 305 to pivot about the common axis of the pivot members 311 and to move the barrier 306 nearer to the peripheral surface of the lowered roll 303. Consequently, the width X of the clearance 315 does not increase beyond the maximum permissible value.

The extent of movement of the rollers 314 along the faces 313*a* of the respective cams 313 is dependent upon the aforediscussed distance S as well as upon the distance R of the point of contact between a cam face 313*a* and the respective roller 314 from the pivot axis which is defined by the respective fulcrum 336. In addition, the extent of movement of the rollers 314 along the respective cam faces 313*a* is dependent upon the distance (T1 or T2) of the axis of a fulcrum 336 from the axis of the respective pin 338. If the distance T is reduced, i.e., if a pin 338 is moved nearer to the respective fulcrum 336, the extent of angular movement of the respective carriage 335 about the fulcrum 336 is increased and the distance of travel of a roller 314 along the respective cam face 313*a* is increased accordingly.

If the roll 303 is relatively small (e.g., if the diameter of such roll is $W_2$), the extent of travel of the rollers 314 along the respective cam faces 313*a* is greater than if the roll 303 has a larger diameter (such as $W_1$). The distance T can be changed in a fully automatic way by resorting to an elongated rod- or bar-shaped distance varying actuator 341 which acts not unlike a link. A first portion 342 of the actuator 341 is articulately connected to the adjacent bearing 309 for the lower roll 303, and a second portion 343 of the actuator is articulately connected to the adjacent bearing 308 for the upper roll 302. As shown in FIGS. 8 to 11, the second portion 343 of the actuator 341 can be movably mounted in the motion transmitting member 340 which is carried by the adjacent bearing 308.

The portions 342, 343 of the actuator 341 are movable in a direction which is substantially parallel to the horizontal plane of the nip 304 but are not movable at right angles to such direction. Otherwise stated, the inclination of the elongated actuator 341 is dependent upon the distance of the bearings 308 for the upper roll 302 from the bearings 309 for the lower roll 303. Each pin 338 is connected to the respective actuator 341 and is located between the portions 342, 343 of such actuator. The portions 342, 343 may but need not constitute the respective end portions of the actuator 341, i.e., the one or the other end of the actuator 341 can extend beyond the portion 342 or 343.

Since the carriages 335 and the portions 342 of the actuators 341 are mounted in the respective bearings 309, the positions of the pins 338 are determined by the inclination of the respective actuators 341. If the distance of the bearings 309 from the bearings 308 is relatively small, i.e., if the diameter of the roll 303 is relatively small, the pins 338 are nearer to the respective fulcra 336 than if a roll 303 having the diameter $W_2$ were to be replaced with a larger roll 303, e.g., a roll having the diameter $W_1$. This can be readily ascertained by comparing the FIGS. 8 and 9.

Figure 11:
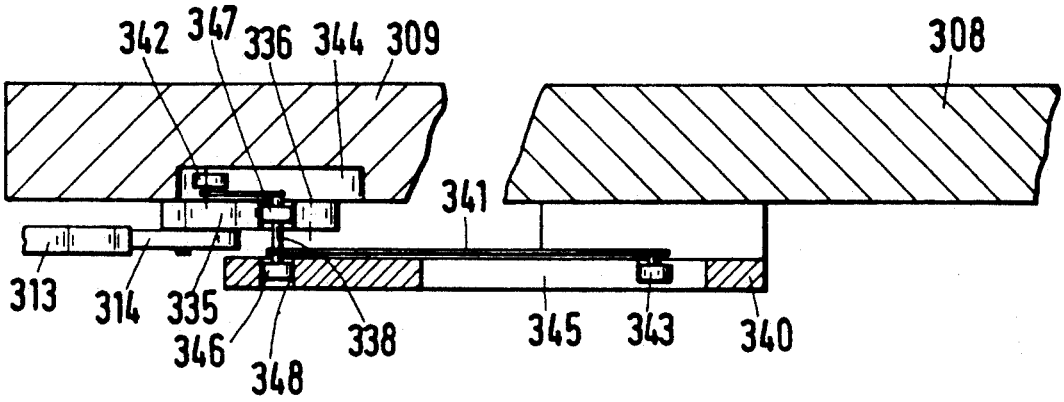
FIG. 11 is an enlarged fragmentary sectional view substantially as seen in the direction of arrows from the line B—B in FIG. 8.

The portions 342, 343 of each actuator or link 341 can be provided with idler rollers which are movable along tracks 344, 345 (e.g., in the form of surfaces bounding slots as shown in FIG. 11). The tracks 344 are provided in the respective bearings 309, and the track 345 are provided in the respective motion transmitting members 340. The rollers render it possible to reduce friction when the portions 342, 343 of an actuator 341 are to be moved in substantial parallelism with the horizontal plane of the nip 304.

The end portions of each pin 338 can also carry friction reducing idler rollers 346, 347 (FIG. 11) which are guided in the respective openings 339 and apertures 348. This also contributes to a reduction of friction so that the displacing device 337 does not encounter much resistance to shifting of the rolls 314 along the faces 313*a* of the respective cams 313.

Figure 8:
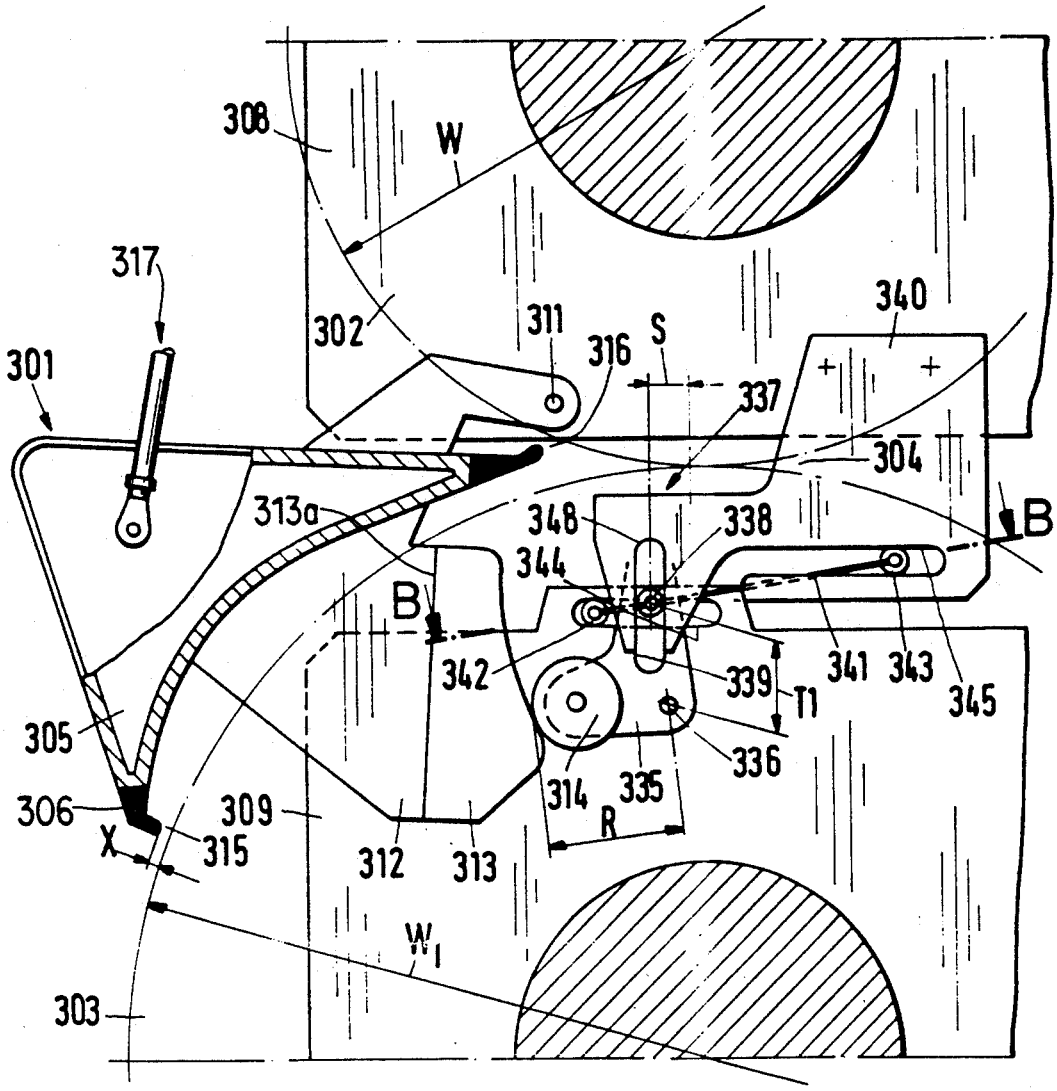
FIG. 8 is a partly end elevational and partly vertical sectional view of a third guard which is installed in a machine of the type shown in FIGS. 5 to 7, the guard being located in front of the nip of the two rolls which are in positions of readiness for use.
Figure 9:
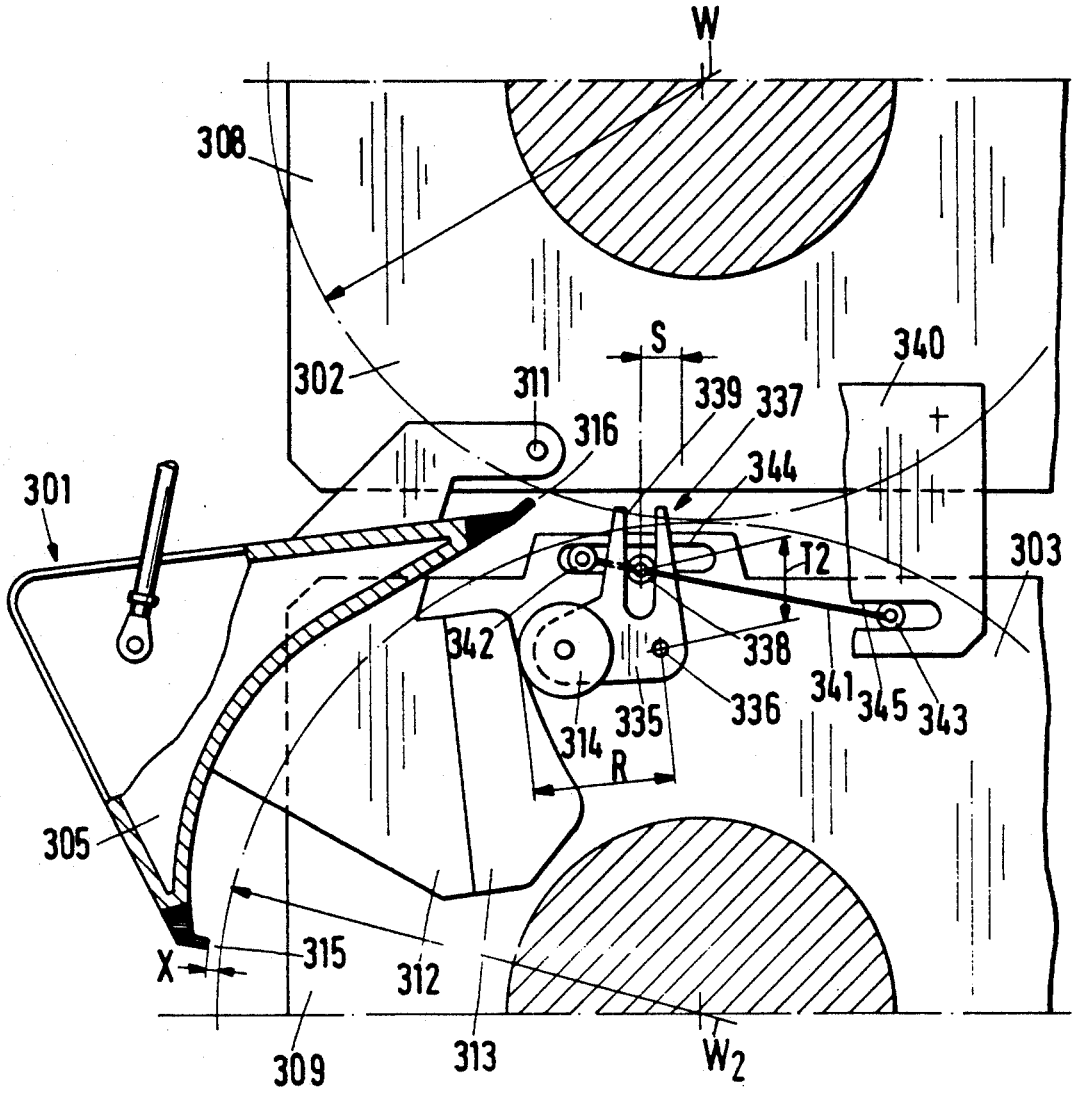
FIG. 9 shows the structure of FIG. 8 except that the lower roll of FIG. 8 is replaced with a smaller-diameter roll.
Figure 10:
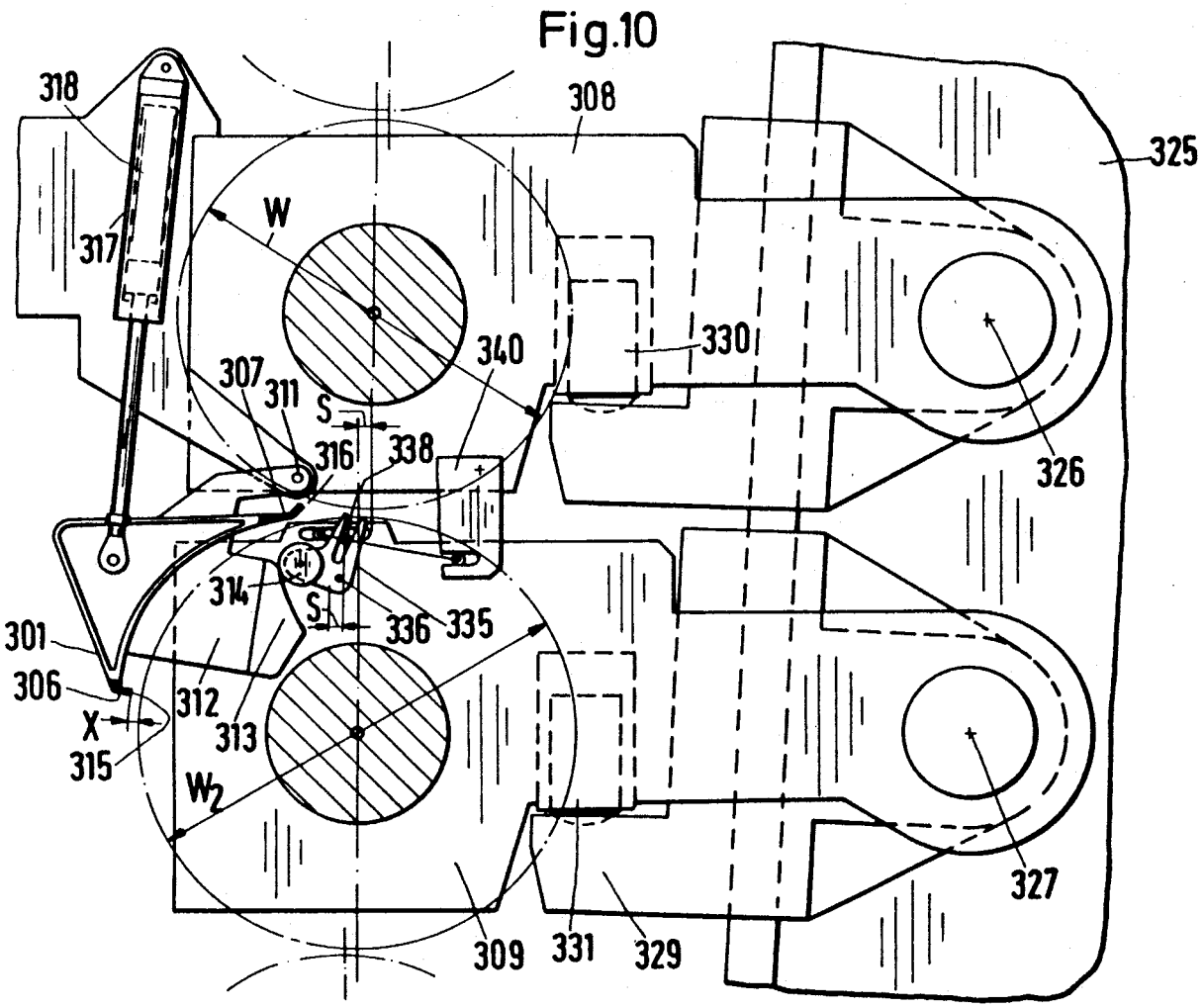
FIG. 10 shows the structure of FIG. 9 but with the lower roll in a lowered position.

An entire motion transmitting member 340 is shown in FIGS. 8 and 11. Only a fraction of a motion transmitting member 340 is shown in FIGS. 9 and 10 for the sake of clarity.

The opening 339 in the upwardly extending arm of the illustrated carrier 335 and the aperture 348 of the illustrated motion transmitting member 340 extend substantially vertically, i.e., at least substantially at right angles to the horizontal plane of the nip 304, when the rolls 302, 303 are ready for use. This is desirable and advantageous because the rocking device 337 is operative irrespective of the distance between the axes of the rolls 302, 303, i.e., even if the roll 302 and/or 303 is replaced with a roll having a larger diameter or a smaller diameter.

The purpose of the actuator or link 341 is to vary the distance of the fulcrum 336 from the pin 338 as a function of changes of the distance of the bearings 309 from the bearings 308. This changes the transmission ratio of the carriage 335 in dependency upon the diameters of the rolls 302, 303 so that the carriage 335 can be pivoted about the axis of the fulcrum 336 through a greater or smaller angle (depending on the distance of the pin 338 from the fulcrum 336) while the distance S between the vertical planes of the axes of the rolls 302, 303 remains unchanged. This renders it possible to account for different positions of the support 305 at different diameters of the rolls 302, 303. If the distance of the pin 338 from the fulcrum 336 is reduced, the angular displacement of the carriage 335 about the axis of the fulcrum 336 is greater, provided that the distance S remains unchanged.

As can be seen in FIGS. 8 to 11, the spaced-apart portions 343 and 342 of the actuator 341 are respectively guided by the bearings 308 and 309. Thus the portion 343 is movable in the track 345 of the motion transmitting device 340 which is affixed to the bearing 308, and the portion 342 is movable in the track 344 of the bearing 309. FIG. 11 shows that the actuator 341 can include a base or holder having two elongated sections which are disposed in parallel planes and are connected to each other by the pin 338 which is located between the portions 342 and 343. The inclination of the tracks 344 and 345 is such that the portions 342, 343 of the actuator 341 have no freedom, or have minimal freedom, of movement at right angles to the horizontal plane of the nip 304. In view of such orientation of the tracks 344 and 345, the inclination of the actuator 341 relative to a horizontal plane is a function of the distance of the bearings 308 from the adjoining bearings 309. In other words, each inclination of the actuator 341 relative to a horizontal plane corresponds to a different distance of a bearing 309 from the adjacent bearing 308. This feature, plus the feature that the pin 338 is mounted on the actuator 341, renders it possible to accurately define the level of the pin 338 relative to the adjacent bearings 308 and 309. Expressed otherwise, each level of the pin 338 corresponds to a particular distance of a bearing 309 from the adjacent bearing 308. Consequently, each angle through which the carriage 335 is pivoted corresponds to a different distance of a bearing 309 from the adjacent bearing 308. In other words, the carriage 335 is pivoted through a relatively small angle (about the axis of the fulcrum 336) in response to a relatively small pivotal movement of a bearing 309 away from the adjacent bearing 308, through a somewhat greater angle if the extent of pivotal movement of the bearing 309 away from the respective bearing 308 is increased, and so forth.

The horizontal plane of the nip 304 is that plane in which a tangent to the peripheral surface of the roll 302 coincides with a tangent to the peripheral surface of the roll 303.

It is preferred to adjustably mount the roller of the actuator portion 343 and/or the roller of the actuator portion 342 on the holder or base of the actuator 341. For example, the shanks or shafts of such rollers can be shifted in suitable slots of the holder or base of the actuator 341 to be held in the newly selected positions by friction, by fasteners or in any other suitable way, not specifically shown. The same applies for the pin 338, i.e., this pin is preferably adjustable to be positioned nearer to the portion 342 or nearer to the portion 343 of the actuator 341. Such adjustability of the rollers of the portions 342, 343 and/or of the pin 338 longitudinally of the actuator 341 renders it possible to select, in advance, the exact width of the clearances 315, 316. Adjustments of the positions of rollers at the portions 342, 343 and/or of the pin 338 longitudinally of the actuator 341 can be carried out during assembly of the machine which embodies the structure of FIGS. 8 to 11.

Though it is also within the scope of the invention to position the actuator portion 342 between the pin 338 and the actuator portion 343, or to position the actuator portion 343 between the pin 338 and the actuator portion 342, the illustrated positioning of the pin 338 between the portions 342, 343 is preferred at this time because the transmission ratio has been found to be particularly satisfactory. Moreover, that part of the actuator 341 which carries the illustrated pin 338 is not subjected to pronounced mechanical stresses.

An advantage of the rollers 346, 347 on the pin 338 is that they contribute to a reduction of friction between the pin 338 on the one hand and the motion transmitting member 340 and the carriage 335 on the other hand. Therefore, the carriage 335 can change its angular position in a highly predictable manner in order to move the roller 314 thereon to an optimum level for engagement with the face 313*a* of the respective cam 313.

The illustrated guards can be modified in a number of additional ways without departing from the spirit of the invention. For example, the cams 13, 213 or 313 can be mounted on the bearings 9, 209 or 309 for the roll 3, 203 or 303 and the rollers 14, 214 or 314 are then mounted on the respective support 5, 205 or 305. Furthermore, the pivot members 11, 211, 311 can be mounted on the bearings 9, 209, 309 for the lower roll 3, 203 or 303 and the motors 17, 217 or 317 are then mounted also on the bearings 9, 209 or 309 for the lower roll. The rollers 14, 214 or 314 (or the cams 13, 213 or 313) are then mounted on the bearings 8, 208 or 308 for the upper roll 2, 202 or 302.

The motors 17, 217 or 317 can be mounted on the bearings 9, 209 or 309 for the lower roll 3, 203 or 303 if the upper roll 2, 202 or 302 is more likely to require frequent inspection, dressing or replacement.

All of the above outlined modifications will be readily understood by those skilled in the relevant art without additional illustrations.

Figure 12:
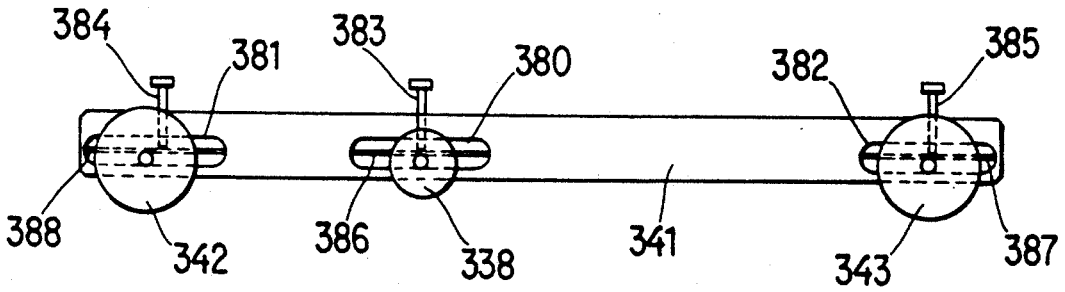
FIG. 12 is an enlarged fragmentary view of FIG. 8.

FIG. 12 shows the actuator 341 in an enlarged scale. The pin 338 as well as the portions 343, 343 are fixed in slots 380, 381, 382 respectively by means of clamping screws 383, 384, 385, respectively, acting against plates 386, 387, 388, respectively, which clamp the pin 383 and the portions 342, 343 to the actuator 341. After loosening of the clamping screws 383, 384, 385, respectively, the position of pin 383 and/or portions 342, 343 can be adjusted within the range of slots 380, 381, 382, respectively. When the clamping screws 383, 384, 385 are retightened thereafter, the respective parts are fixed in the desired position within the actuator 341.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims

I claim:

1. A guard for an elongated nip of first and second rolls which have substantially cylindrical peripheral surfaces and spaced apart parallel axes of rotation and are installed in a machine wherein the first and second rolls are respectively rotatable in first and second bearings and at least one of the bearings is movable relative to the other bearing to vary the spacing of the axes and the distance of the bearings from each other, comprising a support at one side of the nip; a first elongated barrier provided on said support in substantial parallelism with the nip and defining with the peripheral surface of the first roll a first clearance having a first maximum width; a second elongated barrier provided on said support in substantial parallelism with the nip and defining with the peripheral surface of the second roll a second clearance having a second maximum width; means for connecting said support to the first bearing, said connecting means defining for the support a pivot axis which is at least substantially parallel to the nip; ad means for changing the angular position of said support relative to said pivot axis in dependency upon changes of the distance of the at least one bearing from the other bearing.

2. A guard for an elongated nip of first and second rolls which have substantially cylindrical peripheral surfaces and spaced apart parallel axes of rotation and are installed in a machine wherein the first and second rolls are respectively rotatable in first and second bearings and at least one of said bearings is movable relative to the other bearing to vary the spacing of the axes, comprising a support at one side of the nip; a first elongated barrier provided on said support in substantial parallelism with the nip and defining with the peripheral surface of the first roll a first clearance having a first maximum width; a second elongated barrier provided on said support in substantial parallelism with the nip and defining with the peripheral surface of the second roll a second clearance having a second maximum width; means for connecting said support to the first bearing, said connecting means defining for the support a pivot axis which is at least substantially parallel to the nip; and means for pivoting said support about said pivot axis in response to movement of the at least one bearing relative to the other bearing, said pivoting means comprising a first abutment on the second bearing and a second abutment on said support, one of said abutments having a cam face which is tracked by the other of said abutments.

3. The guard of claim 2, wherein said other abutment includes a roller.

4. The guard of claim 2, further comprising means for adjustably supporting at least one of said abutments.

5. The guard of claim 2 further comprising means for urging one of said abutments against the other of said abutments.

6. The guard of claim 5 for the nip of rolls in a machine wherein the second roll is movable relative to the first roll along a predetermined path between an operative position in which the rolls define the nip and an inoperative position, wherein said urging means comprises a reversible motor having means for pivoting said support in a first direction to maintain the cam face in engagement with said other abutment in the operative position of the second roll, and in a second direction to a retracted position away from said path so that the second roll is free to move along said path.

7. The guard of claim 2, further comprising a carriage mounting said first abutment for movement away from said support in response to movement of the at least one bearing away from the other bearing.

8. The guard of claim 7 for the nip of rolls in a machine wherein the at least one bearing is pivotable relative to the other bearing in a machine frame, further comprising a cam rigid with the frame and means for urging said carriage against said cam.

9. The guard of claim 8 for the nip of rolls in a machine wherein the frame includes a carrier for said cam, said urging means including means for biasing said support so that said second abutment bears against said first abutment and said first abutment urges said carriage against said cam.

10. The guard of claim 8, wherein said carriage comprises a roller which engages said cam.

11. The guard of claim 10, wherein said first abutment comprises a second roller on said carriage, said second abutment having a second cam including said cam face and bearing against said second roller under the action of said biasing means.

12. The guard of claim 2 for the nip of rolls in a machine wherein the at least one bearing is pivotable relative to the other bearing in a machine frame, further comprising a carriage for said first abutment and a fulcrum rockably connecting said carriage to the second bearing and means for rocking said carriage relative to the second bearing in response to pivoting of the at least one bearing relative to the other bearing.

13. The guard of claim 12, wherein said carriage has an opening and said rocking means comprises a motion transmitting member rigid with the first bearing and a coupling element connecting said member with said carriage and extending into said opening.

14. The guard of claim 13, wherein said coupling element includes a pin.

15. The guard of claim 13, wherein said member has an aperture which registers with said opening and said coupling element includes a pin which extends into said opening and into said aperture.

16. The guard of claim 15, wherein said aperture and said opening are elongated and extend substantially at right angles to the nip.

17. The guard of claim 13, wherein said coupling element is movable toward and away from said fulcrum and further comprising means for varying the distance of said coupling element from said fulcrum in response to pivoting of the at least one bearing relative to the other bearing.

18. The guard of claim 17, wherein said distance varying means comprises an elongated actuator including a first portion connected with the first bearing and a second portion connected with the second bearing, said coupling element being provided on said actuator.

19. The guard of claim 18, wherein said portions of said actuator are movable relative to the respective bearings and the bearings comprise means for preventing or limiting the movements of said portions of said actuator transversely of the nip.

20. The guard of claim 19, further comprising means for adjustably mounting said coupling element on said actuator.

21. The guard of claim 19, wherein said actuator comprises a holder for said portions and means for adjustably connecting at least one portion of said actuator to said holder.

22. The guard of claim 19, wherein said coupling element is disposed between said portions of said actuator.

23. The guard of claim 13, wherein said coupling element includes a friction reducing portion which engages said carriage.

24. The guard of claim 23, wherein said friction reducing portion includes a roller.

25. The guard of claim 13, wherein said coupling element includes a friction reducing portion which engages said motion transmitting member.

26. The guard of claim 25, wherein said friction reducing portion includes a roller.

* * * * *